United States Patent [19]

Quinn

[11] Patent Number: 4,658,877

[45] Date of Patent: Apr. 21, 1987

[54] LOCK MECHANISM FOR RETRACTABLE AWNING

[75] Inventor: Antony W. Quinn, Westminster, Colo.

[73] Assignee: The Scott & Fetzer Company, Westlake, Ohio

[21] Appl. No.: 710,604

[22] Filed: Mar. 11, 1985

[51] Int. Cl.[4] ..... E04F 10/06

[52] U.S. Cl. ..... 160/46; 160/71; 160/67; 135/89

[58] Field of Search ..... 160/46, 67, 47; 312/313; 108/47, 48; 135/89

[56] References Cited

U.S. PATENT DOCUMENTS

| | | | |
|---|---|---|---|
| 3,324,869 | 6/1967 | Duda | 135/89 |
| 4,077,419 | 3/1978 | Lux | 135/89 |
| 4,117,876 | 10/1978 | Bennett | 160/67 |
| 4,171,013 | 10/1979 | Clark | 135/89 |

*Primary Examiner*—Ramon S. Britts
*Assistant Examiner*—Cherney S. Lieberman

[57] ABSTRACT

An improved upper bracket is provided for a retractable awning of the type which includes a flexible cover sheet anchored along one edge to a vertical support surface with the opposite edge of the cover sheet being secured to a roll bar adapted to be moved toward and away from the supporting surface so that the awning can be retracted or extended respectively. The roll bar has a pair of support arms connected at opposite ends thereof which are adapted to support the roll bar at a pre-selected elevation from the horizontal surface and a pair of brace members extendable from an upper bracket to an associated end of the roll bar to hold the roll bar in an extended position spaced from the vertical support surface. A lower bracket is also mounted on the vertical support surface beneath the upper bracket and is adapted to retain the distal end of an associated brace member as well as a lower end of an associated support arm when the awning is in its retracted position. The improved upper bracket includes an automatic latch and easy locking system for securing the awning in its retracted position.

5 Claims, 10 Drawing Figures

LOCK MECHANISM FOR RETRACTABLE AWNING

BACKGROUND OF THE INVENTION

1. Field of the Invention

The present invention relates generally to retractable type awnings and more particularly to a new and improved lock mechanism for retaining the awning in a retracted position.

2. Description of the Prior Art

Retractable awnings of the type which are movable between a retracted position adjacent a vertical supporting surface and an extended position wherein they extend away from the supporting surface so as to cover a patio area or provide shade for a window or door opening, have been extensively employed. They are used not only on permanent building structures but also on moving vehicles such as of the recreational vehicle type.

In their most common form, the awnings include a flexible fabric or vinyl cover material which is anchored along one edge to the vertical supporting surface and have an opposite edge secured to a roll bar whereby the flexible cover can be rolled around the roll bar as the awning is moved from its extended to retracted position. Typically, the roll bar will include preloaded biasing springs which urge the awning into its retracted position and a pair of brace members at opposite ends of the awning to retain the awning in the extended position thereby preventing the biasing springs from being operative. A pair of support arms are also typically connected at opposite ends of the roll bar to retain a preselected elevation for the roll bar when the awning is extended. The support arms are adapted to either engage a horizontal supporting surface, such as the ground, or the vertical surface to which the upper edge of the awning is secured.

A problem addressed by all manufacturers of retractable awnings and particularly those which are adapted to be mounted on the side of moving vehicles is the tendency for the awning to unroll as air currents are passed thereacross. One system for holding the awning in its retracted position adjacent the side of a moving vehicle or the like is to lift each end of the awning up so that it can be seated in a retaining seat provided on an upper bracket assembly mounted on the vertical support surface. Strong wind currents or jolting of the vehicle, however, will sometimes lift the end of the awning out of its seat thereby allowing the awning to become unrolled or partially extended and frequently causing extensive damage thereto. Another problem with such a system, which has sometimes been referred to as a "lift-to-lock" system, is that virtually the entire weight of the awning needs to be lifted in order to place it in the seat provided therefor. Many users of these awnings are not strong enough to lift this weight or if they are, they do not like lifting all the weight.

SUMMARY OF THE INVENTION

The present invention is directed toward an improved upper bracket for a retractable awning with the upper bracket including an automatic latch and easy locking system which avoids the problems inherent in the conventional "lift-to-lock" systems.

The upper bracket is utilized in connection with a fairly conventional retractable awning wherein a flexible cover sheet is anchored along one edge to a vertical support surface with the opposite edge of the cover sheet being secured to a roll bar adapted to be moved toward and away from the supporting surface so that the awning can be retracted or extended respectively. The roll bar has a pair of support arms connected at opposite ends thereof which are adapted to support the roll bar at a preselected elevation from a horizontal surface and a pair of brace members extendible from an upper bracket to an associated end of the roll bar to hold the roll bar in an extended position spaced from the vertical support surface. A lower bracket is also mounted on the vertical support surface beneath the upper bracket and is adapted to retain the distal end of an associated brace member as well as the lower end of an associated support arm when the awning is in its retracted position.

The lock mechanism of the present invention includes a pivotal lock element that is bifurcated to define two legs forming a V-shaped notch so that a cooperating activator near the end of the roll bar can engage one leg of the bifurcated element to pivot the element whereby the second leg will follow the activator to confine and hold the activator between the legs. With the activator so confined, the brace member which is associated with the lock element and is adjustable in length, can be secured to form a fixed spacing between the bifurcated element and the lower bracket member thereby retaining the bifurcated element in a locking position wherein the roll bar is secured adjacent the vertical supporting surface for the awning.

To further secure the awning in the retracted position and to prevent unfurling or an unrolling of the roll bar, one or both ends of the roll bar includes a gear member which is fixed to the roll bar for unitary rotation therewith and the gear member is adapted to mesh with a locking cog on the upper bracket when the awning is in the retracted position.

The lock mechanism is thereby automatically operable to secure opposite ends of the roll bar to the vertical supporting surface so that the roll bar can be easily fixed in this locked position without the necessity of lifting the awning as in many prior art systems.

Other aspects, features and details of the present invention can be more completely understood by reference to the following detailed description of a preferred embodiment, taken in conjunction with the drawings, and from the appended claims.

DETAILED DESCRIPTION OF A PREFERRED EMBODIMENT

Figures 1, 2:
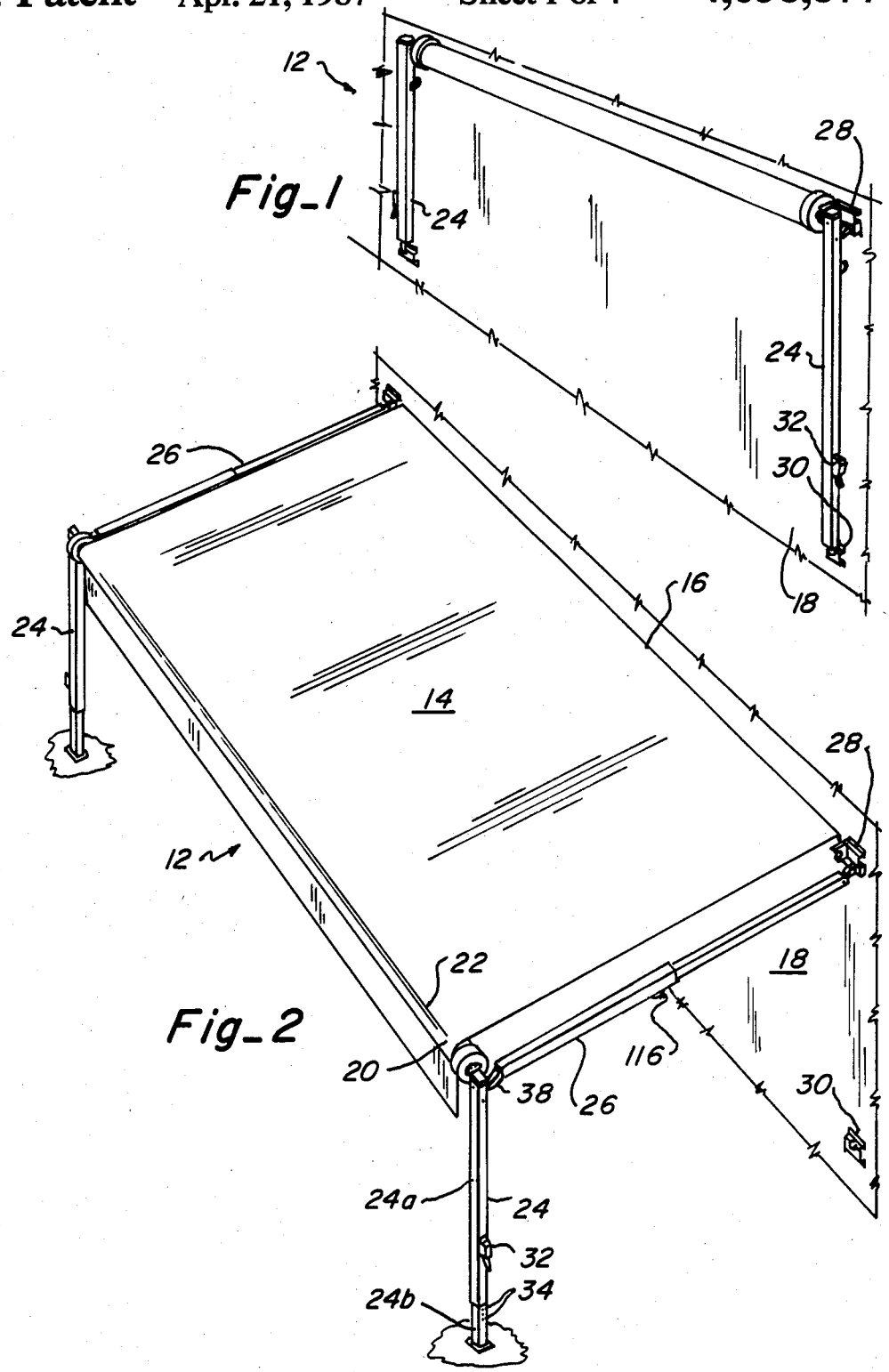
FIG. 1 is a perspective view of a retractable awning incorporating the lock mechanism of the present invention in a retracted position.
FIG. 2 is a perspective view of the retractable awning illustrated in FIG. 1 in an extended position.
Figure 3:
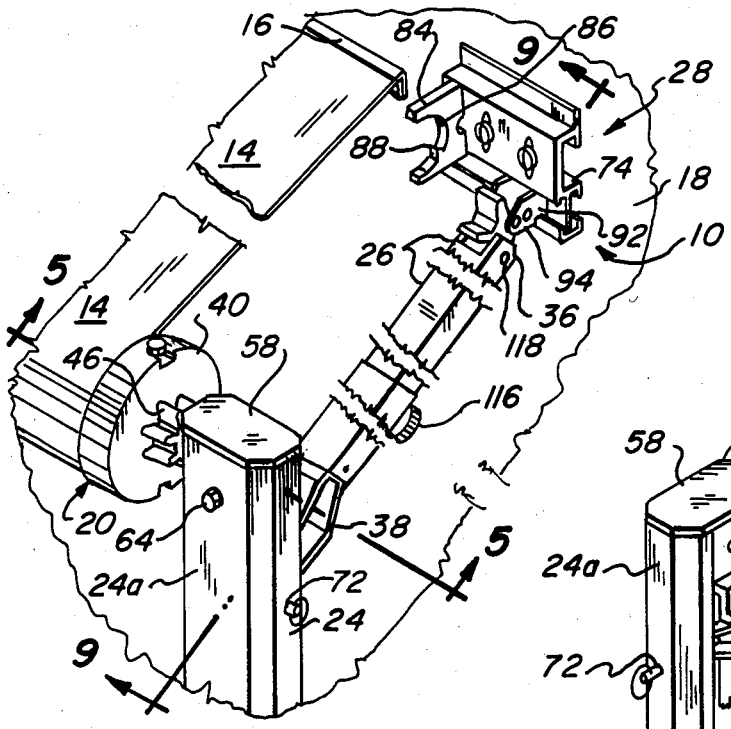
FIG. 3 is an enlarged fragmentary perspective view of one end of the retractable awning in the extended position.
Figure 4:
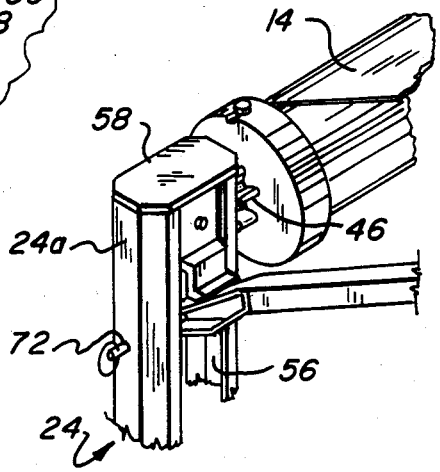
FIG. 4 is an enlarged fragmentary perspective view of one end of a roll bar, support arm and brace member in the extended position.

The lock mechanism 10 of the present invention is adapted for use in a retractable awning 12 of the type illustrated in FIGS. 1 and 2 which includes a flexible cover 14 of generally rectangular shape having an inner edge 16 attached to a vertical supporting surface 18, a roll bar 20 attached to the opposite or outer edge 22 of the cover, a pair of support arms 24, a pair of brace members 26, and a pair of upper and lower bracket members 28 and 30 respectively mounted on the vertical support surface 18 for the awning.

The inner edge 16 of the flexible cover 14, which is typically made of a fabric or vinyl material, is secured to the support surface 18 in any suitable manner so as to extend between the two upper brackets 28. The opposite or outer edge 22 of the flexible cover is secured to the roll bar 20 in a manner such that the cover will wrap around the roll bar when the awning is moved from an extended position, as illustrated in FIG. 2, to a retracted position, as illustrated in FIG. 1.

In a conventional manner, the roll bar 20 is provided with internally disposed preloaded springs 31 (FIG. 5) which bias the awning into the retracted position of FIG. 1. The support arms 24 are pivotally connected to opposite ends of the roll bar in a manner which will be described in more detail hereinafter and are each made from upper and lower telescoping members 24*a* and 24*b* respectively such that the length of each support arm can be adjusted through movement of a handle 32 which is adapted to insert and retract a securement pin (not seen) through an opening in the outer telescoping member 24*a* and into a selected one of a plurality of openings 34 provided on the inner telescoping member 24*b*. In this manner, the elevation of the roll bar 20 from a horizontal supporting surface such as the ground can be selectively obtained. The brace members 26 are also telescopic in construction and have an attached end 36 pivotally connected to the upper bracket member 28 and a distal end 38 which is operatively engageable with an associated end of the roll bar 20 to hold the roll bar in an extended position and can be freely pivoted downwardly so as to be removably secured to the associated lower bracket member 30 such as when the awning is placed in its retracted position.

Figure 5:
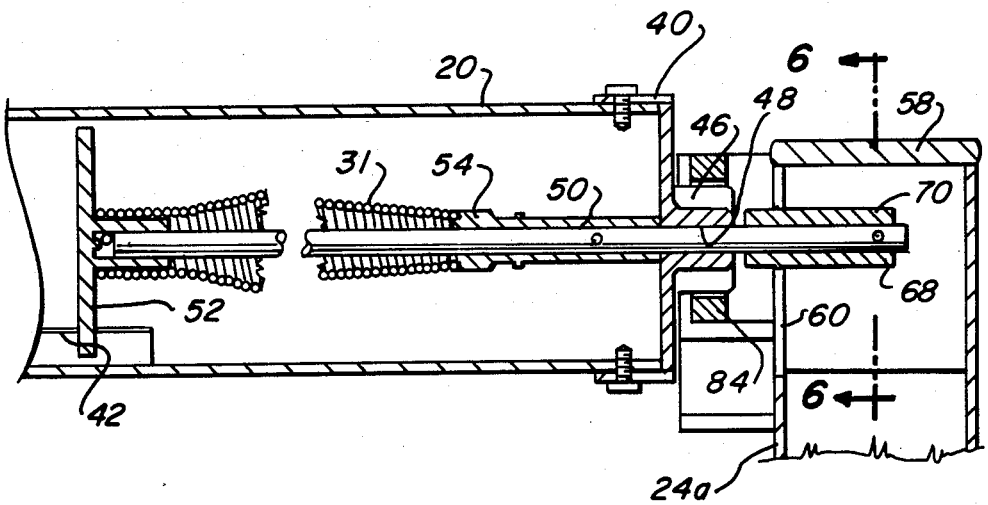
FIG. 5 is a section taken along line 5—5 of FIG. 3.

As mentioned previously, the outer edge 22 of the flexible cover 14 is secured to the roll bar 20 which is probably best illustrated in FIG. 5 to comprise a hollow tubular member having an end cap 40 secured at each end so as to partially close the normally open ends of the roll bar. The roll bar has a longitudinally extending and inwardly projecting groove 42 in which the outer edge 22 of the flexible cover is secured as by inserting the outer edge into the groove and passing a retaining rod (not seen) through a loop (not seen) provided along the outer edge of the cover. The rod is larger than the opening into the groove 42 which passes through the outer surface of the roll bar so that the rod prevents the outer edge of the cover from being pulled out of the roll bar. This system for connecting the cover to the roll bar is not illustrated since it is very commonly used in the art.

Each end cap 40 has a centrally located hub projecting longitudinally away from the end of the roll bar with the hub being in the form of a star wheel or gear 46 having a plurality of radially directed teeth and a central axial opening 48 providing a support for a shaft 50 which supports the assoicated end of the roll bar. The shaft 50 projects inwardly and has the coil spring 31 wrapped therearound which is adapted to bias the roll bar toward its retracted position illustrated in FIG. 1. Movement of the roll bar from the retracted position of FIG. 1 to the extended position of FIG. 2 further tensions the coil springs 31 to increase the bias placed on the roll bar. The support shaft carries a dog 52 on its innermost end which is engageable with the inwardly projecting groove 42 on the roll bar so that as the roll bar is rotated the dog is caused to rotate about the support shaft 50 along with the roll bar itself to increase or decrease the tension in the coil spring depending on the direction of rotation. The opposite end of the coil spring from the dog 52 is fixably secured to a sleeve 54 that is pinned to the support shaft 50 so that as the dog and roll bar body are rotating about the support shaft, the tension in the spring is increased or decreased, again depending on the direction of rotation. The outer most end of the support shaft is adapted to be pivotally connected to an associated support arm 24 in a manner which will be described later.

The support arms 24, as mentioned previously, each consist of an upper and lower telescopic member 24*a* and 24*b* respectively with the upper member 24*a* being of larger cross sectional size than the lower member 24*b*. Both the upper and lower members, however, are of generally U-shaped cross section so as to define a longitudinally extending slot 56 in the side thereof which faces the supporting surface 18. The lower telescoping member is provided with the aligned group of spaced holes 34 through the outer side of the member which are adapted to be aligned with a lock or securement pin (not seen) which protrudes through an opening (not seen) in the outer side of the upper telescoping member. The lock pin can be inserted into one of the aligned holes 34 in the lower telescoping member by the handle mechanism 32 to releasably fix the length of the support arm in a manner well known in the art. Obviously, when the lock pin is removed from one of the openings 34 in the lower telescoping member, the lower member can be slid into the upper member so that the overall length of the supporting arm is approximately equal to the spacing between the upper and lower brackets 28 and 30 respectively.

Figure 7:
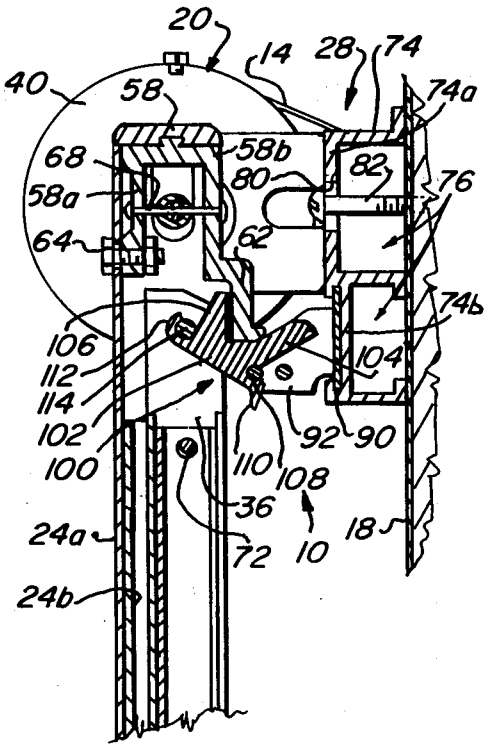
FIG. 7 is a vertical section similar to FIG. 6 with the awning in a fully retracted position.
Figure 6:
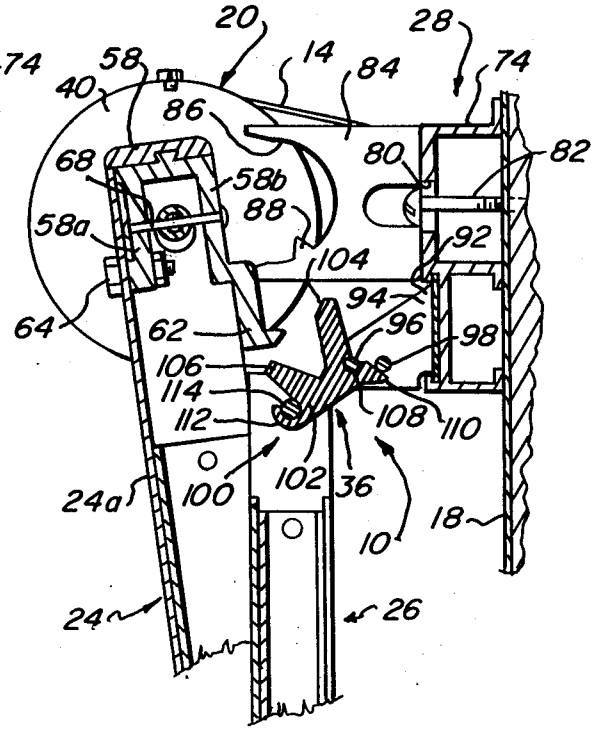
FIG. 6 is a section taken along line 6—6 of FIG. 5 showing the awning in a position just prior to being fully retracted.
Figure 8:
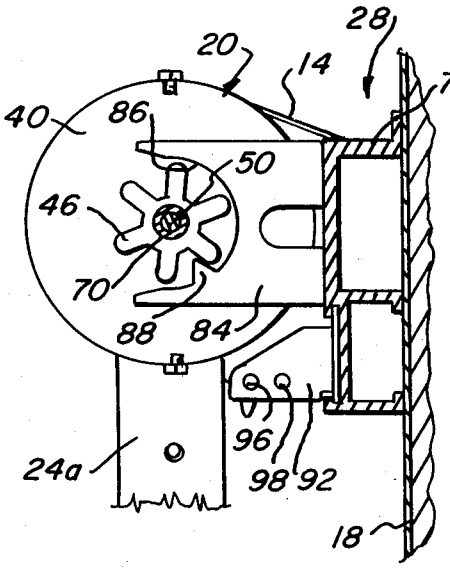
FIG. 8 is a vertical section adjacent one end of the roll bar illustrating the gear system for preventing rotation of the roll bar in the retracted position of the awning.
Figures 9, 10:
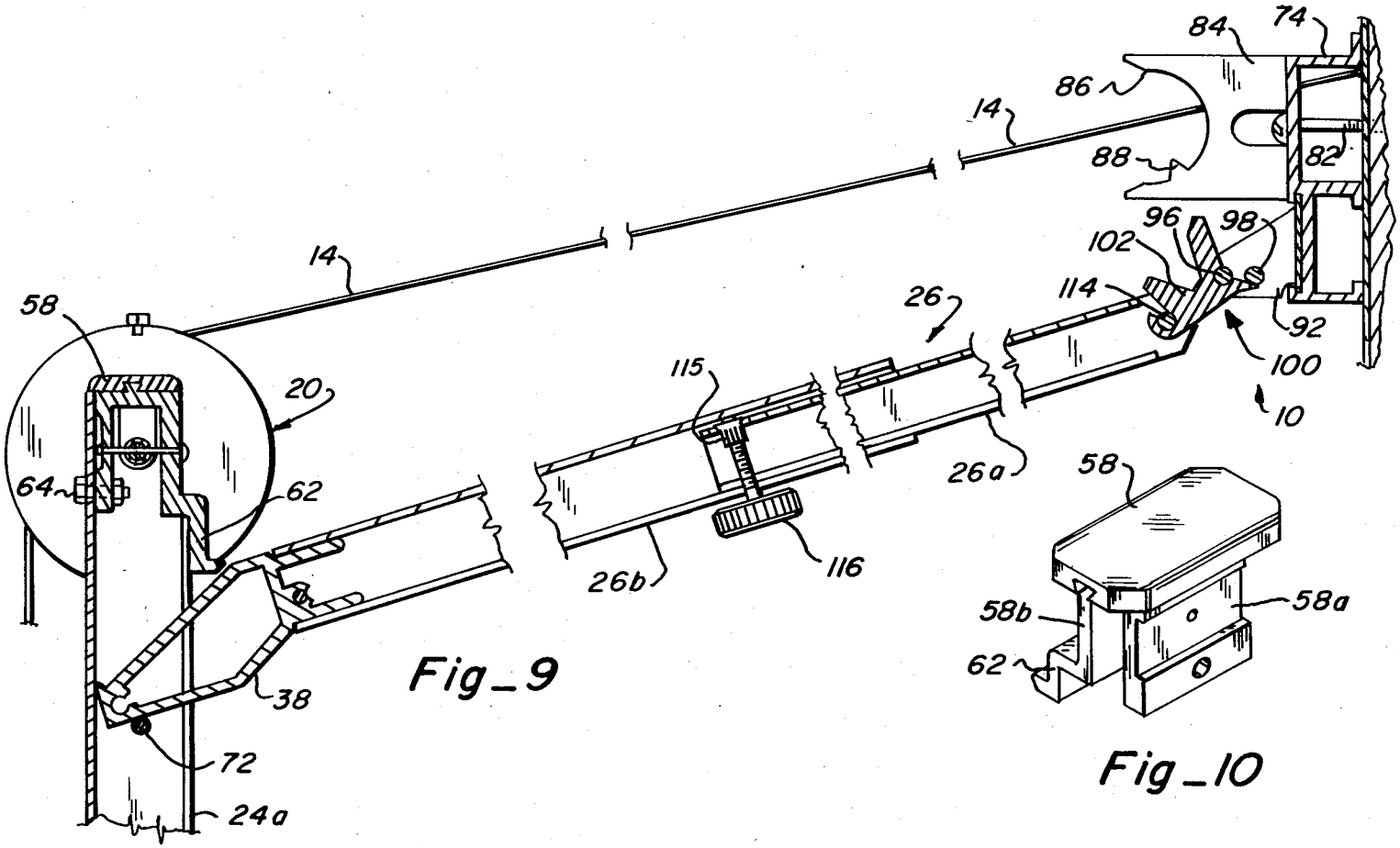
FIG. 9 is an enlarged section taken along line 9—9 of FIG. 3.
FIG. 10 is a perspective view of the end cap piece used on the end of a support arm for the awning shown in FIG. 1.

Referring particularly to FIGS. 4 through 7, 9 and 10, it will be appreciated that the upper end of each support arm 24 has an end cap 58 to close off the otherwise open end of the support arm. A short longitudinal slot 60 is also provided adjacent the upper end of the support arm in the upper telescoping member 24*a* along the side thereof which faces the adjacent end of the roll bar 20. The end cap 58, which is probably best seen in FIGS. 6, 7 and 10, is of substantially inverted U-shaped cross section and defines two downwardly extending legs 58*a* and 58*b* with an activator arm 62 projecting even further downwardly from the lower edge of the leg 58*b* closest to the support surface 18. The end cap is secured to the top end of the support arm by a fastener 64 and further has a pair of aligned openings through the downwardly extending legs 58*a* and 58*b* thereof through which a pivot pin 68 can be passed. The pivot pin 68 passes transversely through the outer end of the support shaft 50 of the roll bar and a sleeve 70 secured on the outer end of the support shaft. This pivotal connection between the support arm 24 and the roll bar 20 allows complete universal movement of the support arm relative to the roll bar since the support shaft 50 is allowed to move longitudinally of the support arm within the slot 60 provided therein and the support arm is rotatably connected to the roll bar via the support shaft. A support pin 72 is also passed through the upper end of the support arm 24 at a location spaced a short distance downwardly from the activator arm 62 which serves a function to be described hereinafter.

The upper bracket 28 which is best illustrated in FIGS. 3, 6, 7 and 8 comprises a base member 74 having upper and lower segments 74*a* and 74*b* respectively defining rearwardly opening channels 76 such that when the bracket is mounted on the supporting surface 18, the channels 76 are placed in a confronting relationship with the support surface. Openings 78 are provided through a front face 80 of the upper segment 74*a* so that screws 82 or other fasteners can be passed through these openings and into the vertical support surface 18 to secure the upper bracket at a desired location on the support surface.

A cog arm 84 protrudes outwardly from one end of the upper segment 74*a* of the upper bracket and is generally rectangular in shape with a substantially semi-circular notch provided in the outermost edge of the arm. The diameter of the semi-circular notch 86 is slightly greater than the diameter of the gears or star wheels 46 on the ends of the roll bar 20 so that an associated gear can be received in the semi-circular notch. The notch includes a triangular shaped cog 88 at a position along a lower portion of the notch so that the cog can protrude into the space between two of the teeth on the gear 46 to prevent rotation of the gear and consequently the roll bar when the gear is received in the semi-circular notch.

As mentioned previously, wind currents passing across the awning when it is in its retracted position frequently catch the flexible cover material and have a tendency to unfurl the cover or unroll the roll bar, and the cog 88 intermeshing with the gear 46 prevents such an unfurling of the cover either during windy conditions or upon movement of the recreational vehicle or the like on which the awning is mounted.

The lower segment 74*b* of the upper bracket member 28 also has a forwardly opening groove 90 in which a generally U-shaped forwardly projecting bracket 92 is secured so as to protrude away from the front face 80 of the bracket in generally parallel relationship with the cog arm 84. The U-shaped bracket 92 has two forwardly protruding legs 94 with front and rear parallel pins 96 and 98 respectively extending between the two legs. The front pin 96, which is disposed a greater distance from the support surface 18 than the rear pin 98, pivotally supports a bifurcated lock element 100 which is probably best illustrated in FIGS. 6 and 7.

In the cross sectional views of the lock element 100 it will be appreciated that it includes a main body 102 with a pair of legs 104 and 106 projecting upwardly and away therefrom so as to form an acute angle relative to each other. The legs may be referred to as first and second legs 104 and 106 respectively with the first leg 104 being closest to the support surface 18 on which the upper bracket 28 is mounted. Near the location where the first leg 104 intersects the main body 102 of the lock element, a transverse channel 108 is provided which is adapted to pivotally receive and retain the front pin 96 which passes between the two forwardly projecting legs 94 on the bracket 92 so that the lock element can freely pivot about this pin. The main body 102 of the lock element also has a flange 110 along its rear edge, which is closest to the support surface 18, with the flange being adapted to abut the rear pivot pin 98 under circumstances to be described hereinafter. A curved flange 112 is provided at the opposite front edge of the main body 102 and is adapted to pivotally receive and retain a third pivot pin 114 connected to an inner end of the brace member which will be described hereinafter. The function of the various component parts of the lock element will become clear with the description of the operation of the lock mechanism to be described later.

The attached end of each of the brace members 26 is pivotally connected to the associated upper bracket 28 via the third pin 114, as mentioned previously. The brace members themselves comprise inner and outer telescoping segments 26*a* and 26*b* respectively of generally U-shaped cross section with the inner segment 26*a*, which is attached to the upper bracket, being of smaller cross sectional area than the outer segment 26*b* and defining a channel in which the outer segment can slide or telescope. The inner segment 26*a* also includes near its end most distant from the upper bracket 28, a locking knob 116 having an externally threaded shaft which is received in an internally threaded sleeve 115 on the inner segment so that the shaft can protrude through an opening in the inner segment and compressively engage the outer segment to releaseably fix the longitudinal relationship of the inner and outer segments. This is not illustrated in detail as it is a very conventional system for selectively securing the longitudinal relationship of telescoping members.

The attached end of the inner segment 26*a* of each brace member 26 includes a pair of aligned openings 118 through which the third pivot pin 114 can pass so that the brace member is suspended from the lock element 100 and can be pivoted with the lock element about the front pin 96. The distal end 38 of the brace member or the outermost end of the outer segment 26*b* is hollow and tapers outwardly in a converging manner. The distal end 38 is capable of protruding into the longitudinal slot 56 at the upper end of the support arm 24 wherein it can rest on the support pin 72 and be wedged under end cap 58 when the awning is in the extended position to releaseably interconnect the brace member with the support arm and retain the awning in the extended position once the length of the brace has been fixed as with the lock knob 116.

When the awning is moved to the retracted position illustrated in FIG. 1, the brace member 26 is withdrawn from the slot 56 in the support arm 24 and pivoted downwardly about the third pin 114 so that the lower end of the brace member can be rested in the associated lower bracket 30, along with the lower end of the associated support arm, adjacent to the supporting surface 18 on which the awning is mounted. The lower bracket 30 is of the type described in detail in copending application Ser. No. 524,455 filed Aug. 18, 1983, now U.S. Pat. No. 4,530,389 which is of common ownership with the subject application, and that application is hereby incorporated by reference. A detailed description of the lower bracket will not be made in this application as it can be found in the incorporated application but suffice it to say that the lower bracket forms a support for both the brace and associated support arm along with a system for releaseably securing the lower ends of both these members to the lower bracket so that both members remain in a parallel relationship to the support surface 18 when the awning is in its retracted position.

As can be appreciated by reference to FIG. 6, each brace member 26 is free to pivot about the front pivot pin 96 when it is moved from the extended position to the retracted position with the inwardly directed flange 110 on the lock element 100 limiting the amount of movement of the lock element about the pivot pin 96 by engagement with the rear pivot pin 98. With the distal or outer end of the brace member 26 resting on the lower bracket, it assumes a substantially vertical orientation as illustrated in FIG. 6 so as to present the first leg 104 of the lock element 100 to the actuator arm 62 at the upper end of the support arm 24. Movement of the support arm into the retracted position of the awning will cause the actuator arm 62 to engage the first leg 104 and pivot the lock element 100 about the outer pin 96 until the lock element assumes the position illustrated in FIG. 7 wherein the second leg 106 of the lock element has followed the actuator arm 62 and disposed the actuator arm between the second leg 106 and the support surface 18. In this position the support arm is blocked or prevented from being moved outwardly toward the extended position of the awning.

As the lock element 100 is being pivoted from the position shown in FIG. 6 to the position shown in FIG. 7, and with the distal end of the brace member seated on the lower bracket with the locking knob 116 loosened, the length of the brace member is extended a short distance by the pivotal movement of the lock element. Once the awning is in the fully retracted position of FIG. 7, the locking knob 116 on the inner segment of the brace member can be advanced against the outer segment to fix the length of the brace member so that it fully fills the space between the upper and lower brackets thereby holding the lock element in its position of FIG. 7 so as to secure the entire awning in the retracted position. It should be appreciated that the awning does not have to be lifted when the awning is moved from the extended to the retracted position as has been the case with prior awnings so that operation of this awning is very convenient and can be managed by men or women of any age.

Another interesting feature of the lock mechanism of the present invention is best illustrated in FIG. 9 wherein it can be seen that when the awning is in the extended position, the third pivot pin 114 lies beneath a longitudinal line passing along the associated brace member and through the outer pivot pin 96 so that an over center locking arrangement exists whereby the inner end of the brace member 26 will not elevate causing the lock element 100 to pivot into its retracted position of FIG. 7.

It will therefore be appreciated that the lock mechanism of the present invention provides a system for very simply extending and retracting a retractable awning of the type typically mounted on the sides of recreational vehicles or the like in a manner such that the weight of the awning does not have to be lifted during any operation and yet when the awning is in the retracted position, it is positively and securely locked in place and prevented from unfurling either by wind currents or a jolting of the vehicle on which the awning is mounted.

Although the present invention has been described with a certain degree of particularity, it is understood that the present disclosure has been made by way of example, and changes in detail or structure may be made without departing from the spirit of the invention, as defined in the appended claims.

I claim:

1. In a retractable awning assembly for attachment to a substantially vertical support surface, said assembly being movable between retracted and extended positions and having a flexible cover material secured along one edge to said support surface, a roll bar secured to an opposite edge of said cover material such that the cover material can be wrapped around said roll bar, a pair of support arms connected to said roll bar adjacent each end thereof, upper and lower pairs of bracket means mounted on said support surface, said upper pair of brackets serving to releasably secure said support arms when the awning is in a retracted position, a pair of longitudally extensible brace members secured at one end to the upper bracket means and adapted to be operably and releasably connected at the opposite end to an associated support arm to retain the awning in the extended position, said opposite ends of the brace members also being adapted to be releasably connected to an associated lower bracket member when the awning is in a retracted position, the improvement comprising a lock element on said upper bracket means associated with each of said brace members and adapted to automatically capture and operatively secure an associated support arm when the roll bar is moved directly from its extended position into engagement with the lock element and into its retracted position, said lock element being pivotally mounted on said upper bracket means for movement between a locking position and a released position and also being pivotally secured to said one end of the associated brace member such that when the opposite end of said brace member is connected to an associated end of said roll bar, the pivotal connection location of the brace member to the lock element can be positioned lower than the pivotal connection location of the lock element on the upper bracket to establish an over-center system for retaining the lock element in its released position when the awning is in an extended position.

2. In a retractable awning assembly for attachment to a substantially vertical support surface, said assembly being movable between retracted and extended positions and having a flexible cover material secured along one edge to said support surface, a roll bar secured to an opposite edge of said cover material such that the cover material can be wrapped around said roll bar, a pair of support arms connected to said roll bar adjacent each end thereof, upper and lower pairs of bracket means mounted on said support surface, said upper pair of brackets serving to releasably secure said support amrs when the awning is in a retracted position, a pair of longitudally extensible brace members secured at one end to the upper bracket means and adapted to be operably and releasably connected at the opposite end to an associated support arm to retain the awning in the extended position, said opposite ends of the brace members also being adapted to be releasably connected to an associated lower bracket member when the awning is in a retracted position, the improvement comprising a lock element on said upper bracket means associated with each of said brace members and adapted to automatically capture and operatively secure an associated support arm when the roll bar is moved directly from its extended position into engagement with the lock element and into its retracted position, said lock element being pivotally mounted on said upper bracket means for movement between a locking position and a release position, said lock element being selectively retainable in the locking position by fixing the length of the associated brace member when said opposite end of the brace member is connected to said associated lower bracket member, and wherein said lock element is pivotally secured to said one end of the associated brace member such that when the opposite end of said brace member is connected to an associated end of said roll bar, the pivotal connection location of the brace member to the lock element can be positioned lower than the pivotal connection location of the lock element on the upper bracket to establish an over-center system for retaining the lock element in its released position when the awning is in an extended position.

3. In a retractable awning assembly for attachment to a substantially vertical support surface, said assembly being movable between retracted and extended positions and having a flexible cover material secured along one edge to said support surface, a roll bar secured to an opposite edge of said cover material such that the cover material can be wrapped around said roll bar, a pair of support arms connected to said roll bar adjacent each end thereof, upper and lower pairs of bracket means mounted on said support surface, said upper pair of brackets serving to releasably secure said support arms when the awning is in a retracted position, a pair of longtitudally extensible brace members secured at one end to the upper bracket means and adapted to be operably and releasably connected at the opposite end to an associated support arm to retain the awning in the extended position, said opposite ends of the brace members also being adapted to be releasably connected to an associated lower bracket member when the awning is in a retracted position, the improvement comprising a lock element on said upper bracket means associated with each of said brace members and adapted to automatically capture and operatively secure an associated support arm when the roll bar is moved directly from its extended position into engagement with the lock element and into its retracted position, said lock element being pivotally mounted on said upper bracket means for movement between a locking position and a release position, said lock element being selectively retainable in the locking position by fixing the length of the associated brace member when said opposite end of the brace member is connected to said associated lower bracket member, and wherein said lock element is of generally v-shaped cross-section having a first and second leg forming an acute angle relative to each other, the legs each having free distal ends and base ends with the base ends being integrally connected by a pivot body portion, the pivot body portion having a first pivot means at which the lock element is pivotally mounted on said upper bracket and second pivot means pivotally connecting the lock element to said one end of an associated brace member.

4. The retractable awning of claim 3 wherein said first pivot means is adjacent to the base of said first leg and the second pivot means is adjacent to the base of said second leg.

5. The retractable awning of claim 4 wherein the roll bar has actuator members operatively connected to opposite ends thereof which are adapted to engage said first leg of an associated lock element as the awning is moved into its retracted position and pivot the lock element about the first pivot means causing the second leg to follow the associated actuator member and capture the actuator in the space between the first and second legs as the lock element is moved into its locking position so that the awning can be held in its retracted position when the lock element is retained in its locking position.

* * * * *